US005260717A

United States Patent [19]

Takeuchi et al.

[11] Patent Number: 5,260,717

[45] Date of Patent: Nov. 9, 1993

[54] RECORDING HEAD HAVING ELECTRICALLY INSULATING LAYER HAVING OPTIMUM SURFACE WAVINESS AND ROUGHNESS

[75] Inventors: Yukihisa Takeuchi, Aichi; Toshikazu Hirota; Nobuo Takahashi, both of Nagoya, all of Japan

[73] Assignee: NGK Insulators, Ltd., Japan

[21] Appl. No.: 933,189

[22] Filed: Aug. 20, 1992

[30] Foreign Application Priority Data

Aug. 23, 1991 [JP] Japan ..... 3-237375

[51] Int. Cl.[5] ..... B41J 2/335

[52] U.S. Cl. ..... 346/76 PH; 346/139 C; 346/155

[58] Field of Search ..... 346/76 PH, 155, 139 C

[56] References Cited

U.S. PATENT DOCUMENTS

| | | | |
|---|---|---|---|
| 4,651,168 | 3/1987 | Terajima et al. . | |
| 4,684,960 | 8/1987 | Nishiwaki . | |
| 4,961,078 | 10/1990 | Takeuchi et al. . | |
| 4,990,934 | 2/1991 | Takeuchi et al. | 346/76 PH |
| 5,059,985 | 10/1991 | Takeuchi et al. | 346/76 PH |
| 5,077,563 | 12/1991 | Takeuchi et al. | 346/76 PH |
| 5,101,221 | 3/1992 | Takeuchi et al. | 346/76 PH |
| 5,132,705 | 7/1992 | Takeuchi et al. | 346/76 PH |

FOREIGN PATENT DOCUMENTS

| | | |
|---|---|---|
| 54-141140 | 11/1979 | Japan . |
| 58-12790 | 1/1983 | Japan . |
| 60-72733 | 4/1985 | Japan . |
| 60-78772 | 5/1985 | Japan . |
| 60-79959 | 5/1985 | Japan . |
| 61-35972 | 2/1986 | Japan . |
| 61-230966 | 10/1986 | Japan . |
| 62-99162 | 5/1987 | Japan . |
| 62-99163 | 5/1987 | Japan . |
| 62-292461 | 12/1987 | Japan . |
| 63-87264 | 4/1988 | Japan . |
| 2101935 | 1/1983 | United Kingdom . |

*Primary Examiner*—Benjamin R. Fuller
*Assistant Examiner*—Huan Tran
*Attorney, Agent, or Firm*—Parkhurst, Wendel & Rossi

[57] ABSTRACT

A recording head including an electrically insulating layer, a plurality of recording electrodes and at least one return circuit electrode provided on the opposite sides of the insulating layer, the insulating layer and electrodes being adapted to be held, at a distal end of the head, in contact with the resistive layer. The electrically insulating layer has a surface waviness represented by maximum filtered waviness, of not larger than 0.40 μm, where a high band cut-off value is 0.8 mm and a reference length is 2.5 mm, as measured in main scanning direction perpendicular to a stacking direction of the electrically insulating layer, the recording and return circuit electrodes. The insulating layer also has a surface roughness represented by center-line mean roughness, within a range of 0.02 μm to 0.4 μm, where a cut-off value is 0.8 mm and a measuring length is 2.5 mm, as measured in the main scanning direction.

17 Claims, 3 Drawing Sheets

RECORDING HEAD HAVING ELECTRICALLY INSULATING LAYER HAVING OPTIMUM SURFACE WAVINESS AND ROUGHNESS

BACKGROUND OF THE INVENTION

1. Field of the Invention

This invention relates in general to a recording head for recording or printing images such as characters and graphical representations, by applying an electric current to a recording medium or a ribbon or film or other form of intermediate member interposed between the recording medium and the recording head. More particularly, the present invention is concerned with construction of a distal end portion of such a recording head at which the head contacts the recording medium or intermediate member to perform high-quality recording.

2. Discussion of the Prior Art

Various types of recording heads for recording by application of an electric current to a recording medium or an intermediate member have been proposed up to the present. In particular, there is known a recording head having a laminar or multi-layered structure which includes an electrically insulating layer or layers, an array of recording electrodes and an array of return circuit electrodes which are supported by or formed on the insulating layer or layers. Examples of this type of recording head are disclosed in laid-open Publication Nos. 61-35972, 62-292461, 54-141140, 58-12790 and 61-230966 of unexamined Japanese Patent Applications.

As disclosed in the publications identified above, the recording head of the type indicated above is adapted such that an electric current is applied to an electrically resistive or conductive layer formed or coated on or carried by a suitable recording medium or a suitable planar intermediate support member in the form of a sheet, film, or ribbon. The electrically resistive or conductive layer may be formed on a roller or other support member, or constitute an inner layer of the recording medium or support member. During recording by using, for example intermediate ribbon or film having an electrically resistive layer and an ink layer, an electric current applied to the resistive layer through the recording head causes Joule heat to be generated by the resistive layer, whereby selected local areas of the ink layer are heated, and the ink material in these heated local areas is fused, vaporized or diffused. As a result, the ink material is transferred to the appropriate local areas of the recording medium so as to form a black or colored image. If an electric current is applied directly to a recording medium, the appropriate local areas of the medium are suitably colored due to Joule heat generated by an electric current, or due to removal of the covering material from the medium surface due to an electrical discharge occurring thereon.

The electrically resistive layer provided on the recording medium or intermediate support member may be an electrically conductive layer, an electrically conductive or resistive ink layer (which serves also as an ink-bearing layer), a heat-sensitive layer having an electrolyte, or any form of layer through which an electric current may flow.

During recording or printing operation by the recording head as described above, the recording electrodes and the return circuit electrodes must be constantly held in good electrical contact with the electrically resistive layer of the recording medium or support member. In the known recording heads of a laminar structure having recording and return circuit electrodes and the electrically insulating layer interposed therebetween, the materials, dimensions and arrangement of the electrodes, insulating layer and other elements are optimally determined so as to assure good electrical contact of the electrodes with the resistive layer.

However, the mere selection of the materials suitable for the electrodes, insulating layer and others, and appropriate dimensions and arrangement thereof are not sufficient for maintaining good and stable electrical contact of each electrode with the resistive layer for a prolonged period of time. Consequently, it is difficult for the known recording heads to provide high-quality printed images having small variation in their density.

SUMMARY OF THE INVENTION

It is therefore an object of the present invention to provide a recording head for recording by application of an electric current to an electrically resistive layer, which recording head assures excellent electrical contact of the electrodes with the resistive layer for a prolonged period of time of use, to permit high-quality recording and to obtain images having small variation in their density.

The above object may be attained according to the principle of the present invention, which provides a recording head operable to apply an electric current to an electrically resistive layer provided on a recording medium or a planar intermediate member interposed between the medium and the recording head, comprising an electrically insulating layer, a plurality of recording electrodes provided on one of opposite sides of the electrically insulating layer, and at least one return circuit electrode provided on the other side of the electrically insulating layer, the electrically insulating layer, the recording electrodes and the return circuit electrode(s) being adapted to be held, at a distal end of the recording head, in contact with the electrically resistive layer, wherein the electrically insulating layer has an exposed end face included in a contact surface of the distal end of the recording head for contact with the recording medium or the planar intermediate member, the end face having a surface waviness represented by maximum filtered waviness, of not larger than 0.40 μm, where a high band cut-off value is 0.8 mm and a reference length is 2.5 mm, as measured in a main scanning direction perpendicular to a direction in which the electrically insulating layer is interposed between the recording electrodes and the return circuit electrode(s). The end face of the electrically insulating layer also has a surface roughness represented by center-line mean roughness (arithmetical mean deviation of the profile, Ra), within a range of 0.02 μm to 0.4 μm, where a cut-off value is 0.8 mm and a measuring length is 2.5 mm, as measured in the main scanning direction.

The recording head of the present invention constructed as described above assures excellent electrical contact of the electrodes with the electrically resistive layer for prolonged period of time of use, to permit a high-quality recording and to obtain images having small variation in their density.

According to one preferred form of the present invention, the electrically insulating layer functions as a substrate for supporting the recording and return circuit electrodes. In this case, the recording, electrodes are formed on one of opposite major surfaces of the substrate, while the return circuit electrode(s) is are formed on the other major surface of the substrate.

According to another preferred form of the present invention, the recording head further has a first substrate for supporting the recording electrodes on one of opposite major surfaces thereof, and a second substrate for supporting the return circuit electrode(s) on one of opposite major surfaces thereof. The first and second substrates are superposed on each other such that the recording electrodes and the return circuit electrode(s) are opposed to each other with the electrically insulating layer interposed therebetween.

The above-indicated substrate for supporting the recording electrodes and/or return circuit electrode(s) may have a proximal portion, and a distal end portion extending from the proximal portion by a predetermined distance from the proximal portion for contact with the electrically resistive layer, the distal end portion having a thickness smaller than that of the proximal portion, as measured in a direction perpendicular to a direction of extension of the distal end portion.

The present invention was developed based on the finding as described below.

In a recording apparatus using a recording head operable to apply an electric current to an electrically resistive layer provided on a recording medium, for example, the exposed end faces of the electrodes must, be constantly held in good contact with the resistive layer during sliding movement of the recording medium relative to the head, so as to enable the apparatus to produce a high-quality image having small density variation. Further, the individual electrodes corresponding to respective dots of the printed image must evenly contact with the resistive layer, without variation in their contacting condition over the entire contact surface of the head. To this end, the contact surface at the distal end of the head, which includes end faces of the electrodes and substrate, must have reduced surface waviness, so that this surface is pressed at an even pressure against the resistive layer. The surface roughness of the contact surface of the head is determined to an optimum value, depending upon the kind of the resistive layer, the pressing pressure of the head and other factors. Generally, the coefficient of friction between the recording head and the resistive layer tends to be increased when the surface roughness of the head is too large or too small. Namely, an excessively large surface roughness of the head results in unstable or poor contact between the electrodes and the resistive layer. When the recording head having an excessively small surface roughness is used with an intermediate film having an ink layer and the resistive layer, the ink layer tends to stick to the contact surface of the head upon energization of the resistive layer by the electrodes. In view of these circumstances, the present invention was developed in an attempt to determine an appropriate surface roughness of the contact surface of the recording head.

BRIEF DESCRIPTION OF THE DRAWINGS

The above and other objects, features and advantages of the present invention will be better understood by reading the following description of presently preferred embodiments of the invention, when considered in connection with the accompanying drawings, in which.

DETAILED DESCRIPTION OF THE PREFERRED EMBODIMENTS

Figure 1:
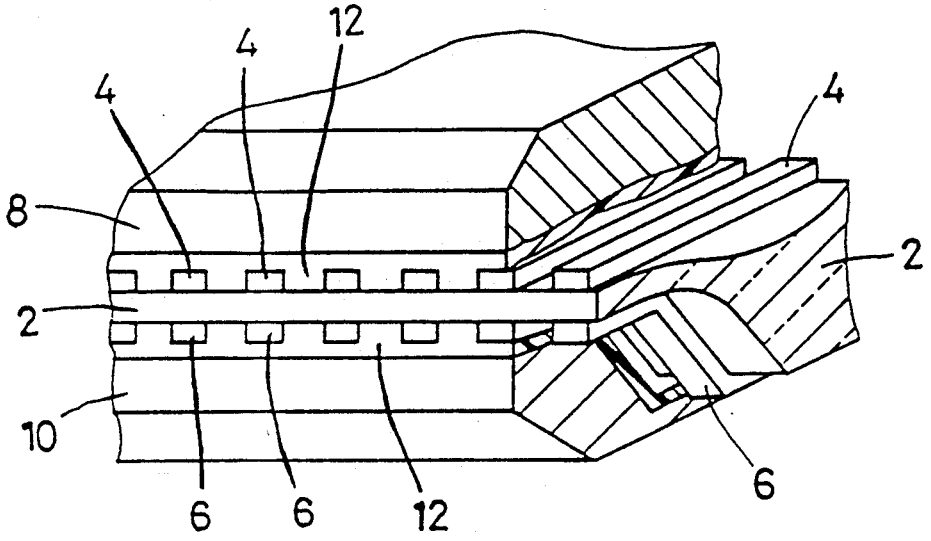
FIG. 1 is a fragmentary perspective view showing one embodiment of a recording head of the present invention.

Referring to FIGS. 1–6, there are shown three different forms of the recording head constructed according to the principle of the present invention, each of which has a laminar or multi-layered structure. In these figures, the same reference numerals are assigned to identify the functionally corresponding elements.

Figure 2:
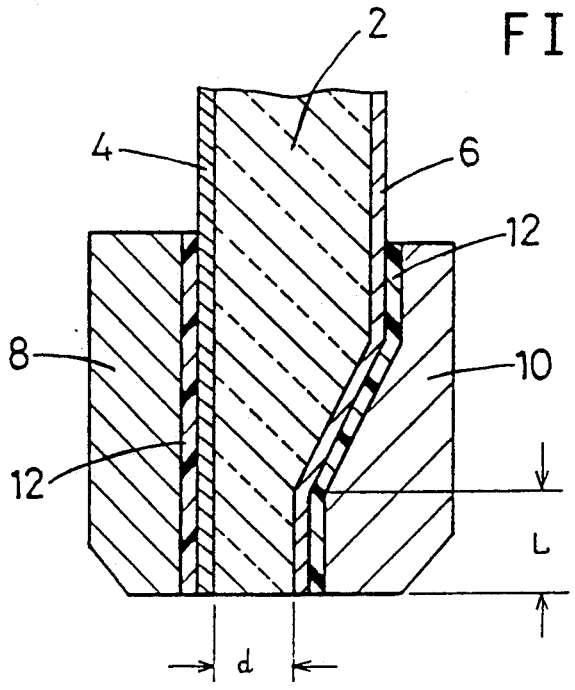
FIG. 2 is a fragmentary elevational view in cross section of a distal end portion of the recording head of FIG. 1, taken in a plane perpendicular to major surfaces of a substrate of the head.

In one form of the recording head as shown in FIGS. 1 and 2, reference numeral 2 denotes an electrically insulating layer which serves as a substrate. On one of the opposite major surfaces of the substrate 2, there is formed an array of recording electrodes 4 in the form of a multiplicity of spaced-apart parallel strips. An array of return circuit electrodes 6 in the form of multiple spaced-apart parallel strips is formed on the other surface of the substrate 2, such that the recording electrodes 4 are aligned with the return circuit electrodes 6 as viewed in the direction of thickness of the substrate 2. The recording head further has a reinforcing layer 8 formed so as to cover the above-indicated one major surface of the substrate 2 on which the recording electrodes 4 are formed, and a heat-dissipating layer 10 formed so as to cover the other surface of the substrate 2 on which the return circuit electrodes 6 are formed. These reinforcing and heat-dissipating layers 8, 10 are bonded to the substrate 2 through respective adhesive layers 12. As is apparent from FIGS. 1 and 2, the recording and return circuit electrodes 4, 6 have, respective end faces, which are exposed at a contact surface of a distal end portion of the recording head for sliding contact with a recording medium, such as a coloring recording paper, or a planar intermediate support member. During operation, the recording medium or intermediate support member is moved relative to the recording head from left to right as seen FIG. 2.

Figure 3:
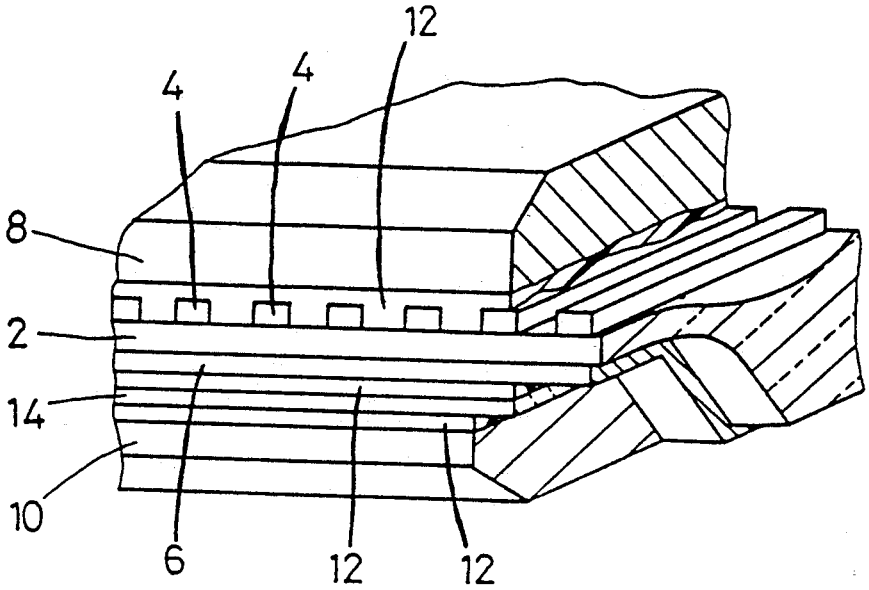
FIG. 3 is a fragmentary perspective view showing another embodiment of a recording head of the present invention.
Figure 4:
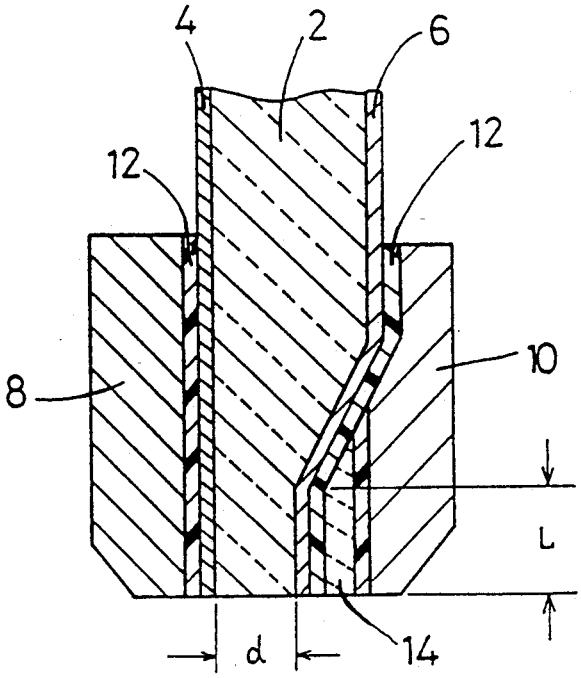
FIG. 4 is a fragmentary elevational view in cross section of a distal end portion of the recording head of FIG. 3, which corresponds to that of FIG. 2.

In another form of the recording head as shown in FIGS. 3 and 4, an electrically insulating thin layer 14 formed of the same material as the substrate 2 is sandwiched between the heat-dissipating layer 10 and the return circuit electrode 6 through intervening adhesive layers 12. Namely, the thin layer 14 is disposed downstream of the substrate 2 as seen in the direction of relative sliding movement of the recording medium, for example, with the head, i.e., from left to right as seen in FIG. 4. Thus, the instant recording head has a distal end portion consisting of the reinforcing layer 8, recording electrodes 4 (or return circuit electrode), substrate 2, return circuit electrode 6 (or recording electrodes), electrically insulating thin layer 14, and heat-dissipating layer 10, which are laminated in the order of description in the above-indicated sliding direction. The return circuit electrode 6 used herein is a sheet member formed on one major surface of the substrate 2.

Figure 5:
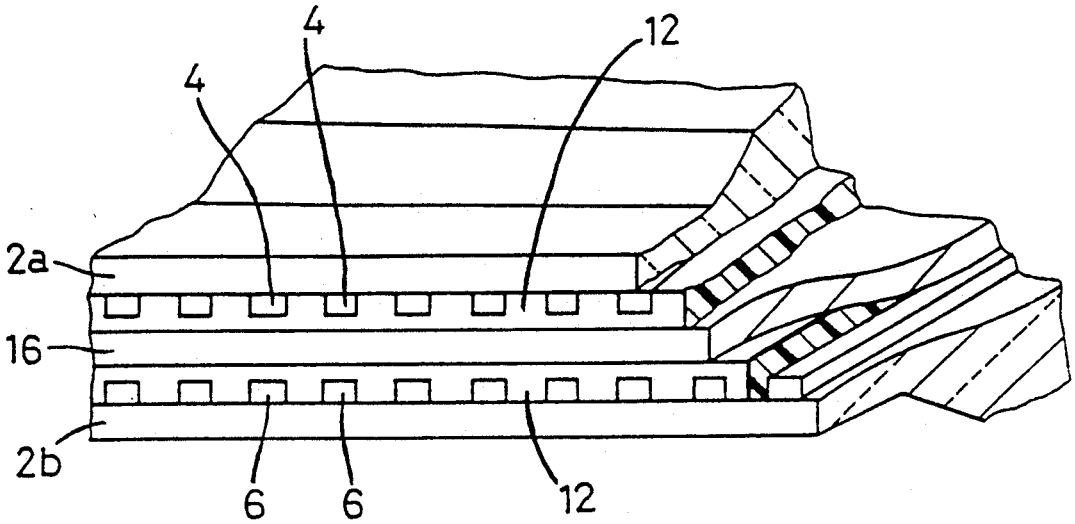
FIG. 5 is a fragmentary perspective view showing a further embodiment of a recording head of the present invention.
Figure 6:
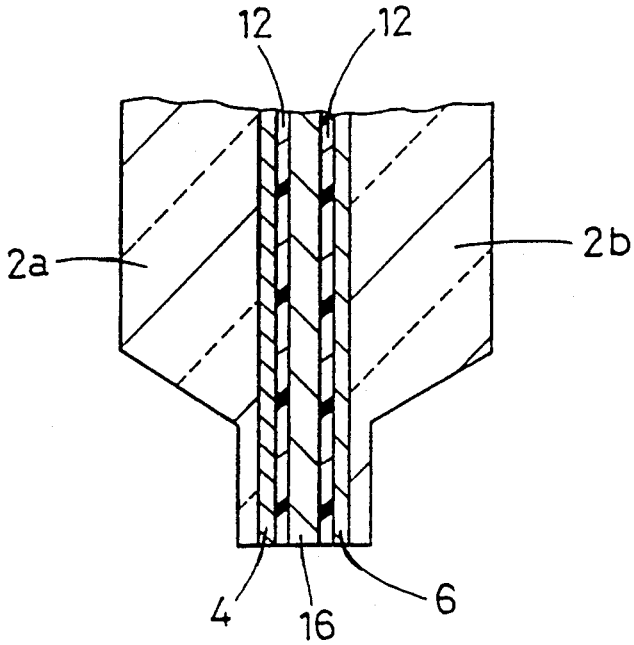
FIG. 6 is a fragmentary elevational view in cross section of a distal end portion of the recording head of FIG. 5, which corresponds to that of FIG. 2.

In a further form of the recording head as shown in FIGS. 5 and 6, an array of recording electrodes 4 in the form of multiple spaced-apart parallel strips are formed on one major surface of a first substrate *2a*, while an array of return circuit electrodes 6 in the form of multiple spaced-apart parallel strips are formed on one major surface of a second substrate *2b*. These first and second substrates *2a*, *2b* are superposed on each other with an electrically insulating layer 16 as a spacer interposed therebetween, such that the recording electrodes 4 are opposed to the return circuit electrodes 6 through the spacer 16. Thus, the instant recording head has a distal end portion consisting of the first substrate *2a*, recording electrodes 4, adhesive layer 12, spacer (or electrically insulating layer) 16, adhesive layer 12, return circuit electrodes 6, and second substrate *2b*, which are laminated in the order of description.

The thus constructed recording head has at its distal end a contact surface which contacts with an electrically resistive layer provided on the recording medium or intermediate support member, which surface includes the end faces of recording electrodes 4, return circuit electrode(s) 6, and the electrically insulating layer 2, 16 interposed between the electrodes 4, 6. According to the present invention, the surface waviness and roughness of the contact surface of the head is held within a desirable range, based on the surface waviness and roughness of the electrically insulating layer (2, 16) as specified below. This leads to maintaining good contact of the electrodes 4, 6 with the electrically resistive layer for a prolonged period of time, so as to enable the head to produce high-quality printed images having small variation in their density.

The surface waviness and roughness values of the contact region of the head with the resistive layer are dependent upon the method of determining these values, and the measurement conditions and measurement area. As the measurement area is selected an end face of the electrically insulating layer (2, 16) which contacts with the resistive layer, since the insulating layer (2, 16) is close to the recording and return circuit electrodes 4, 6, and the end face of the insulating layer does not include the joining interfaces of the different materials of the electrodes 4, 6, substrate 2 spacer 16) and adhesive layers 12. The above-described advantages or effects of the present invention can be achieved by specifying the surface quality of the end face of the insulating layer (2, 16) as described below.

The surface quality of the end face of the electrically insulating layer (2, 16) for contact with the resistive layer is measured in the direction of arrangement of the recording electrodes 4, in other words, a main scanning or printing direction perpendicular to the direction of lamination of the recording and return circuit electrodes 4, 6 and the insulating layer (2, 16). The surface waviness is specified by referring to "maximum filtered waviness" as defined by JIS B 0610-1976, while the surface roughness is specified by referring to "center-line average roughness" as defined by JIS B, 0601-1982. More specifically, the surface quality of the end face of the insulating layer (2, 16) for contact with the resistive layer is controlled such that the "maximum filtered waviness" as defined by JIS B 0610-1976 is 0.40 μm or smaller where the high band cut-off value is 0.8 mm and the reference length is 2.5 mm, and such that the "center-line mean roughness" (arithmetical mean deviation of the profile, Ra) as defined by JIS B 0601-1982 is within a range of 0.02 μm to 0.4 μm where the cut-off value is 0.8 mm and the measuring length is 2.5 mm. Preferably, the "maximum filtered waviness" is 0.20 μm or smaller, and the "center-line mean roughness" is within a range of 0.04 μm to 0.20 μm.

In the recording head constructed as described above, the substrate 2 which bears the recording and return circuit electrodes 4, 6 is formed of a material which has a lower wear resistance than the material of the electrodes (4, 6). Preferably, the substrate 2 is formed of a ceramic material which has a lower wear resistance and a lower hardness than the material of the electrodes 4, 6, and which can be easily processed or shaped with high precision. It is particularly desirable to form the substrate 2 of a ceramic material selected from the group which consists of: highly machinable glass ceramic containing mica; alumina ($Al_2O_3$) having a relatively low wear resistance; boron nitride; highly machinable ceramic containing boron nitride; highly machinable glass ceramic containing boron nitride; highly machinable ceramic containing boron nitride and aluminum nitride; and highly machinable glass ceramic containing boron nitride and aluminum nitride. In particular, the highly machinable glass ceramic containing mica is preferably used.

The substrate 2 has a proximal portion (upper portion as seen in FIGS. 2 and 4 which is located remote from the recording medium during operation of the head, and a thin-walled distal end portion (lower portion as seen in the figures) which extends from the proximal portion by a suitable length or distance in the direction toward the recording medium, for sliding contact with the recording medium or planar intermediate support member. The thin-walled distal end portion has a thickness "d" which is smaller than the thickness of the proximal portion, as measured in the direction perpendicular to the direction of extension of the distal end portion from the proximal portion. The distal end portion, which has the thickness "d" over a length "L", is formed by forming a recess or cutout in the end portion of at least one of the opposite major surfaces of the substrate 2. The thus formed thin-walled distal end portion, having an even thickness over the length "L" parallel to the direction in which the substrate 2 wears, supports the electrodes 4, 6 with a sufficiently high mechanical strength, while assuring good contact of the electrodes (4, 6) with the resistive layer for a prolonged period of time.

The thickness "d" and the length "L" of the distal end portion of the substrate 2 are suitably determined depending upon the materials of the electrodes 4, 6 and substrate 2, the required properties or characteristics of the distal end portion to be exhibited during a recording operation, and the desired force of electrical contact of the electrodes 4, 6 with the resistive layer of the recording medium or planar intermediate support member. Generally, the thickness "d" is preferably 150 μm or smaller, more preferably within a range of 25–90 μm, while the length "L" is preferably within a range of 50–4000 μm, more preferably within a range of 100–1000 μm.

Where the substrate 2 supporting the electrodes 4, 6 has the thin-walled distal end portion extending from the proximal portion by the above length "L", the reinforcing layer and/or heat-dissipating layer is/are preferably bonded to one or both of the opposite major surface of the substrate 2. When the reinforcing or heat-dissipating layer is provided on the major surface in which the cutout is formed, the layer follows the contour of the major surface. The reinforcing layer thus provided serves to increase the mechanical strength of the distal end portion to be commensurate with that of the proximal portion, while the heat-dissipating layer serves to avoid heat accumulation which would otherwise occur at the distal end portion. In the embodiments of FIGS. 1–4, the reinforcing layer 8 is favorably formed of the same material as the substrate 2, while the heat-dissipating layer 10 is formed of a material having a high thermal conductivity. For instance, the heat-dissipating layer 10 is formed from a metal sheet, a metal sheet whose surface is treated, for electrical insulation, a sheet formed of boron nitride or aluminum nitride.

Each adhesive layer 12 used for bonding the reinforcing and heat-dissipating layers 8, 10 to the substrate 2 may be an inorganic adhesive containing alumina, silica, boron nitride, or other inorganic material, or a resinous adhesive containing epoxy, phenol or polyimide, for example. Alternatively, the adhesive layer 12 may be a mixture of an inorganic material such as alumina, silica or boron nitride, and a resin. Among these adhesives, an inorganic adhesive containing alumina, silica, boron nitride or other inorganic material is most preferably used.

The recording electrodes 4 and return circuit electrode(s) 6 provided on the opposite major surfaces of the substrate 2 or on the respective major surfaces of the first and second substrates 2*a*, 2*b* are formed of an electrically conductive material which has a higher degree of wear resistance than the material of the substrate 2; 2*a*, 2*b* which supports the electrodes 4, 6. Preferably, a major content of the electrically conductive material for the electrodes 4, 6 is selected from the group which includes: metals such as chronium, titanium, tantalum and zirconium; alloys containing these metals; and compounds of these metals. These materials are advantageously used owing to their comparatively high wear resistance and comparatively low rate of consumption due to an electrical effect during use of the head. Particularly, chromium, and an alloy or a compound containing chromium are preferably used as a major component of the electrically conductive material for the electrodes 4, 6. More preferably, the electrodes are formed principally of an alloy or compound containing both chromium and nitrogen. The electrodes 4, 6 may be formed by first forming respective films of the selected electrically conductive material, by a suitable technique such as sputtering, vapor deposition, ion plating, CVD (chemical vapor deposition}, coating, printing or plating, and then patterning the films into the respective arrays of the spaced-apart parallel electrode strips 4, 6, by a suitable method such as etching or lift-off method. Desirably, the electrodes 4, 6 have a thickness of at least 1 μm. If needed, the electrodes 4, 6 are plated with nickel, tin, chromium, copper, gold or other suitable metal.

Where the substrate 2 and reinforcing layer 8 are formed of a material having a comparatively low thermal conductivity, such as a highly machinable glass ceramic containing mica, while the heat-dissipating layer 10 is formed of a material having a comparatively high thermal conductivity, such as boron nitride, the mere selection of combination of these materials for the substrate 2 and layers 8, 10 is not sufficient to finely adjust or control a heat-accumulating characteristic of the distal end portion of the head. If the distal end portion is excellent in its heat-dissipating capability, the recording head is operated requiring increased energy consumption, due to reduced sensitivity of the recording head to the heat generated by the resistive layer. If the distal end portion is excellent in its heat-accumulating capability, the ink material tends to spread beyond nominal areas of the selected local spots on the recording medium, whereby the printed images are likely to get blurred or foggy. In the embodiment as shown in FIGS. 3 and 4, the thin layer 14 formed of the same material as the substrate 2 and having a relatively low thermal conductivity is interposed between the substrate 2 and the heat-dissipating layer 10, so as to control the heat-accumulating characteristic of the distal end portion of the head. In a recording operation by this recording head for use with an intermediate film having an electrically resistive layer and an ink layer, therefore, the heat generated by the resistive layer is applied to appropriate local areas of the ink layer to fuse the ink material, and then immediately dissipated through the intermediate film toward the head after printing of images. Thus, the energy consumption by the head can be significantly reduced by efficiently utilizing the heat generated by the resistive layer for recording images, and at the same time the printed images are free from blurs since the heat is immediately dissipated toward the head after being used for recording the images. Further, the instant recording head can stably establish good contact of the electrodes 4, 6 with the resistive layer of the intermediate film, since the electrodes 4, 6 are interposed between the reinforcing layer 8 and substrate 2 and between the substrate 2 and thin layer 14, respectively, as viewed in the direction of sliding movement of the intermediate film (resistive layer), while these substrate and layers 2, 8, 14 are formed of the same material.

The test samples of the recording heads as illustrated in FIGS. 1 and 2 (FIGS. 3 and 4) were prepared in the following manner:

To produce the recording heads as illustrated in FIGS. 1 and 2, the substrate 2 was formed from a highly machinable glass ceramic sheet containing mica, and chromium films formed by sputtering on the opposite major surfaces of the glass ceramic sheet were patterned by photo-etching method, and heat-treated in an atmosphere containing a nitrogen gas and a hydrogen gas. Thereafter, the thus patterned chromium layers were plated with chromium, and then heat-treated in an atmosphere containing a nitrogen gas and a hydrogen gas, to form respective arrays of spaced-apart parallel strips of chromium. Thus, an array of the recording electrodes 4 in the form of 768 chromium strips was formed on one of the opposite major surfaces of the substrate 2, such that the electrode strips 4 are spaced apart from each other at a spacing pitch of 125 μm. Each electrode strip 4 has a width of 75 μm and a thickness of 15 μm. On the other major surface of the substrate 2, an array of the return circuit electrodes 6 was formed in the same manner as the recording electrodes 4. The distal end portion of the substrate 2 has a thickness "d" of 75 μm, and a length "L" of 800 μm.

The reinforcing layer 8 was formed by machining a highly machinable glass ceramic sheet containing mica, which is similar to the glass ceramic sheet used for the substrate 2. The heat-dissipating layer 10 was formed from a boron nitride sheet. The thus prepared reinforcing layer 8 was formed on the above-indicated one major surface of the substrate 2 which bears the recording electrodes 4, while the heat-dissipating layer 10 was formed on the other major surface of the substrate 2 which bears the return circuit electrodes 6. These layers 8, 10 were bonded to the respective major surfaces of the substrate 2 with an inorganic adhesive agent 12 containing alumina. Thus, the recording heads of FIGS. 1 and 2 each having a laminar structure were produced.

To produce the recording heads as illustrated in FIGS. 3 and 4, the substrate 2 was formed from a highly machinable glass ceramic sheet containing mica, and chromium-molybdenum films formed by sputtering on the opposite major surfaces of the glass ceramic sheet were patterned by photo-etching method, to form an array of spaced-apart parallel strips on one of the opposite major surfaces, and a layer or sheet covering the other major surface. These chromium-molybdenum strips and sheet were heat-treated in an atmosphere containing a nitrogen gas and a hydrogen gas. Thus, an array of the recording electrodes 4 in the form of 480 parallel strips was formed on the above-indicated on major surface of the substrate 2, such that the electrode strips 4 are spaced apart from each other at a spacing pitch of 125 μm. Each electrode strip 4 has a width of 80 μm and a thickness of 15 μm. On the other major surface of the substrate 2 was formed the return circuit electrode 6 in the form of a sheet. The distal end portion of the substrate 2 has a thickness "d" of 80 μm, and a length "L" of 1000 μm.

The reinforcing layer 8 was formed by machining a highly machinable glass ceramic sheet containing mica as used of the substrate 2, and was bonded to the one major surface of the substrate 2 which supports the recording electrodes 4, by means of an inorganic adhesive agent 12 containing alumina. The thin layer 14 prepared from a highly machinable glass ceramic sheet containing mica as used for the substrate 2 was formed in thickness of 100 μm on the other major surface of the substrate 2 which supports the return circuit electrode 6, and was bonded thereto with the inorganic adhesive agent 12 containing alumina. The heat-dissipating layer 10 formed from a boron nitride sheet was bonded to the outer surface of the thin layer 14 remote from the substrate 2, by using the iorganic adhesive agent 12 containing alumina.

To prepare the test samples No. 1 through No. 6 as indicated in TABLE 1 below, the contact surfaces of the recording heads produced as described above, which are in contact with an electrically resistive layer during a recording operation, were finished or lapped by using a sand paper or lapping film supported by a glass or rubber sheet, or a lapping machine with an abrasive. The electrically insulating layer (2) of each test sample No. 1–No. 6 was the specific surface quality, i.e., surface waviness and roughness, as indicated in TABLE 1.

The samples No. 1–No. 6 of the recording heads produced as described above were tested as incorporated in a recording apparatus, such that the electrodes 4, 6 were held in sliding contact with a film-like recording medium having the electrically resistive layer, during repetitive printing cycles. The quality of the images printed by the individual recording heads was evaluated. The test revealed satisfactory results on samples No. 2, No. 3, No. 5 and No. 6, namely, sufficiently high density and clearness or crispness of the printed images, which were not subject to changes overtime. Of these samples, the recording heads of Nos. 5 and 6 produced betters results in the sensitivity of the recording head to the heat generated by the energized resistive layer, than those of Nos. 2 and 3.

TABLE 1

| | Sample No. | Surface quality of End face of Electrically insulating layer (2) Waviness*(WCM) (μm) | Roughness**(Ra) (μm) | |
|---|---|---|---|---|
| FIG. 1 | 1 | 1.10 | 0.50 | Comparative |
| | 2 | 0.20 | 0.20 | Present |
| | 3 | 0.12 | 0.04 | Invention |
| | 4 | 0.06 | 0.01 | Comparative |
| FIG. 3 | 5 | 0.16 | 0.08 | Present |
| | 6 | 0.12 | 0.04 | Invention |

*Waviness is specified by referring to "maximum filtered waviness" as defined by JIS B 0610-1976, which was measured where the high band cut-off value was 0.8 mm and the reference length was 2.5 mm.

**Roughness is specified by referring to "center-line means roughness" as defined by JIS B 0601-1982, which was measured where the cut-off value is 0.8 mm and the measuring length is 2.5 mm.

When a recording apparatus using the recording head of the comparative sample No. 1 was operated in print images on a film-like recording medium, on the other hand, the electrodes 4, 6 were in varying or unstable contact with the recording medium, resulting in great variation in the density of the images printed by the apparatus. In a recording operation by a recording apparatus using the recording head of sample No. 4 for use with a film-like recording medium, the recording medium stuck to the recording head several times, resulting in a failure to feed the recording medium, or an increased contact resistance which prevents stable contact between the recording medium and the head. Consequently, the images printed by this recording apparatus had an undesirably low density.

While the present invention has been described in detail in its presently preferred embodiments, it is to be understood that the invention is not limited to the details of the illustrated embodiments, but may be embodied with various changes, modifications and improvements, which may occur to those skilled in the art, without departing from the spirit and scope of the invention defined in the following claims.

What is claimed is:

1. A recording head operable to apply an electric current to an electrically resistive layer provided on a recording medium or on a planar intermediate member interposed between said recording medium and the recording head, comprising an electrically insulating layer, a plurality of recording electrodes provided on one of opposite sides of said electrically insulating layer, and at least one return circuit electrode provided on the other side of said electrically insulating layer, said electrically insulating layer, said recording electrodes and said at least one return circuit electrode being adapted to be held, at a distal end of the recording head, in contact with said electrically resistive layer, wherein said electrically insulating layer has an exposed end face included in a contact surface of said distal end of the recording head for contact with the electrically resistive layer, said end facing having:

a surface waviness not larger than 0.40 μm as measured along a reference length of 2.5 mm in a main scanning direction, said surface waviness being represented by maximum filtered waviness, wherein a high band cut-off value is 0.8 mm, and the main scanning direction is perpendicular to a stacking direction of said electrically insulating layer, said recording electrodes and said at least one return electrode; and a surface roughness within a range of 0.02 μm to 0.4 μm as measured along a reference length of 2.5 mm in the main scanning direction, said surface roughness being represented by a centerline mean roughness, wherein a cut-off value is 0.8 mm.

2. The recording head of claim 1, wherein said surface waviness of said end face of said electrically insulating layer is not larger than 0.20 μm.

3. The recording head of claim 1, wherein said surface roughness of said end face of said electrically insulating layer is within a range of 0.04 μm to 0.20 μm.

4. The recording head of claim 1, wherein said electrically insulating layer has a lower wear resistance than said recording electrodes and said at least one return circuit electrode.

5. The recording head of claim 4, wherein said electrically insulating layer is formed of a material selected from the group consisting of: highly machinable glass ceramic containing mica; alumina having a relatively low wear resistance; boron nitride; highly machinable ceramic containing boron nitride; highly machinable glass ceramic containing boron nitride; highly machinable ceramic containing boron nitride and aluminum nitride; and highly machinable glass ceramic containing boron nitride and aluminum nitride.

6. The recording head of claim 1, wherein said electrically insulating layer supports said recording electrodes and said at least one return circuit electrode, said recording electrodes being formed on one of opposite major surfaces of said electrically insulating layer, said at least one return circuit electrode being formed on the other major surface of said electrically insulating layer.

7. The recording head of claim 6, wherein said electrically insulating layer has a proximal portion, and a distal end portion extending from the proximal portion by a predetermined distance from the proximal portion for contact with said electrically resistive layer, said distal end portion having a thickness smaller than that of said proximal portion, as measured in a direction perpendicular to a direction of extension of said distal end portion.

8. The recording head of claim 7, wherein the thickness of said distal end portion is 150 μm or smaller.

9. The recording head of claim 8, wherein the thickness of said distal end portion is within a range of 25–90 μm.

10. The recording head of claim 7, wherein the length of said distal end portion is within a range of 50–4000 μm.

11. The recording head of claim 10, wherein the length of said distal end portion is within a range of 100–1000 μm.

12. The recording head of claim 7, further comprising a reinforcing layer formed of the same material as used for said electrically insulating layer, for reinforcing said distal end portion of said electrically insulating layer, said reinforcing layer being bonded to said one of opposite major surfaces of said electrically insulating layer which bears said recording electrodes.

13. The recording head of claim 7, further comprising a heat-dissipating layer provided on the other major surface of said electrically insulating layer which bears said at least one return circuit electrode, for dissipating heat accumulated at the distal end of the recording head upon energization of said electrically resistive layer.

14. The recording head of claim 13, further comprising a thin layer interposed between said electrically insulating layer and said heat-dissipating layer, said thin layer being formed of the same material as said electrically insulating layer and having a lower thermal conductivity than said heat-dissipating layer.

15. The recording head of claim 1, further comprising a first substrate for supporting said recording electrodes on one of opposite major surfaces thereof, and a second substrate for supporting said at least one return circuit electrode on one of opposite major surfaces thereof, said first and second substrates being superposed on each other such that said recording electrodes and said at least one return circuit electrode are opposed to each other with said electrically insulating layer interposed therebetween.

16. The recording head of claim 15, wherein each of said first and second substrates has a proximal portion, and a distal end portion extending from the proximal portion by a predetermined distance, from the proximal portion for contact with said electrically resistive layer, said distal end portion having a thickness smaller than that of said proximal portion, as measured in a direction perpendicular to a direction of extension of said distal end portion.

17. The recording head of claim 1, wherein said recording electrodes and said at least one return circuit electrode are formed of an electrically conductive material whose major component consists of a metal containing at least one material selected from the group consisting of chromium, titanium, tantalum and zirconium, or a compound thereof.

* * * * *